US006572220B1

(12) United States Patent
Ross et al.

(10) Patent No.: US 6,572,220 B1
(45) Date of Patent: Jun. 3, 2003

(54) BEAM MICRO-ACTUATOR WITH A TUNABLE OR STABLE AMPLITUDE PARTICULARLY SUITED FOR INK JET PRINTING

(75) Inventors: David S. Ross, Fairport, NY (US); Antonio Cabal, Webster, NY (US); Gilbert A. Hawkins, Mendon, NY (US); John A. Lebens, Rush, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/152,194

(22) Filed: May 21, 2002

(51) Int. Cl.[7] ..... B41J 2/06
(52) U.S. Cl. ..... 347/55
(58) Field of Search ..... 347/55, 151, 120, 347/141, 103, 123, 111, 159, 127, 128, 131, 125, 158; 399/271, 290, 292, 293, 294, 295

(56) References Cited

U.S. PATENT DOCUMENTS 1,941,001 A 12/1933 Hansell
3,373,437 A 3/1968 Sweet et al.
3,416,153 A 12/1968 Hertz et al.
3,878,519 A 4/1975 Eaton
4,346,387 A 8/1982 Hertz
4,646,106 A 2/1987 Howkins
5,739,832 A 4/1998 Heinzl et al.
5,880,759 A 3/1999 Silverbrook
6,079,821 A 6/2000 Chwalek et al.

*Primary Examiner*—Raquel Yvette Gordon
(74) *Attorney, Agent, or Firm*—Norman Rushefsky

(57) ABSTRACT

An ink jet printing apparatus and method for generating droplets of a printing liquid from a nozzle of an inkjet printhead features a temperature responsive vibrating beam constrained at both ends of the beam within or near a nozzle having an exit opening, the beam being continuously vibrated within the printing liquid in response to electrical pulsing applied to the beam so that the beam vibrates at a predetermined frequency and the beam is at a temperature that is characterized by frequency of vibration that is substantially at a local minimum point whereby minor excursions in temperature of the beam from the local minimum point temperature provides substantially minimal changes in frequency and amplitude of vibration of the beam. A heating element located at or near the exit outlet of the nozzle is selectively heated to provide a heat pulse to a meniscus of the printing liquid at the nozzle exit outlet to selectively control droplet formation and/or droplet direction leaving the printhead.

30 Claims, 6 Drawing Sheets

BEAM MICRO-ACTUATOR WITH A TUNABLE OR STABLE AMPLITUDE PARTICULARLY SUITED FOR INK JET PRINTING

FIELD OF THE INVENTION

This invention generally relates to an ink jet printer that uses an oscillating microelectromechanical actuator to break up a fluid stream in a continuous inkjet printer, or to assist in the selective generation of microdroplets of ink in a drop-on-demand system.

BACKGROUND OF THE INVENTION

Many different types of digitally controlled printing systems have been invented, and many types are currently in production. These printing systems use various actuation mechanisms, various marking materials, and various recording media. Examples of digital printing systems in current use include: laser electrophotographic printers; LED electrophotographic printers; DOT matrix impact printers; thermal paper printers; film recorders; thermal wax printers; dye diffusion thermal transfer printers; and ink jet printers. However, at present, such electronic printing systems have not significantly replaced mechanical presses, even though this conventional method requires very expensive set-up and is seldom commercially viable unless a few thousand copies of a particular page are to be printed. Thus, there is a need for improved digitally-controlled printing systems that are able to produce high-quality color images at a high speed and low cost using standard paper.

Ink jet printing is a prominent contender in the digitally controlled electronic printing arena because, e.g., of its non-impact, low-noise characteristics, its use of plain paper, and its avoidance of toner transfers and fixing. Inkjet printing mechanisms can be categorized as either continuous inkjet or drop-on-demand ink jet. Continuous inkjet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected toward the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets that pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

U.S. Pat. No. 6,079,821, which issued to Chwalek et al. in 2000, discloses a method and apparatus for a continuous ink jet printing system in which a continuous stream of ink is broken into droplets by the application of heat at a nozzle, and is deflected for the purpose of printing by an asymmetric application of heat at the same nozzle.

Drop-on-demand inkjet printers selectively eject droplets of ink toward a printing medium to create an image. Such printers typically include a printhead having an array of nozzles, each of which is supplied with ink. Each of the nozzles communicates with a chamber which can be pressurized in response to an electrical impulse to induce the generation of an ink droplet from the outlet of the nozzle. Many such printers use piezoelectric transducers to create the momentary pressure necessary to generate an ink droplet. Examples of such printers are present in U.S. Pat. Nos. 4,646,106 and 5,739,832.

While such piezoelectric transducers are capable of generating the momentary pressures necessary for useful drop-on-demand printing, they are relatively difficult and expensive to manufacture since the piezoelectric crystals (which are formed from a brittle, ceramic material) must be micromachined and precision installed behind the very small ink chambers connected to each of the ink jet nozzles of the printer. Additionally, piezoelectric transducers require relatively high voltage, high power electrical pulses to effectively drive them in such printers.

To overcome these shortcomings, drop-on-demand printers that use thermally-actuated paddles were developed. Each paddle includes two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave which effectively ejects a droplet of ink out of the nozzle outlet.

Unfortunately, while such thermal paddle transducers overcome the major disadvantages associated with piezoelectric transducers in that they are easier to manufacture and require less electrical power, they do not have the longevity of piezoelectric transducers. Additionally, they do not produce as powerful and sharp a mechanical pulse in the ink, which leads to a lower droplet speed and less accuracy in striking the image medium in a desired location. Finally, thermally-actuated paddles work poorly with relatively viscous ink mediums due to their aforementioned lower power characteristics.

U.S. Pat. No. 5,880,759, which issued to Silverbrook in 1999, discloses a class of two-stage drop-on-demand printing systems in which a selection mechanism, which determines which nozzles on a printhead are to emit drops, and a separation mechanism, which ejects drops from the selected nozzles, are combined.

U.S. Pat. No. 6,276,782 B1 and U.S. Ser. No. 2001/0045973 A1 disclose a drop on demand ink jet printer wherein electrical pulses are provided to a thermally-actuated paddle and a heater that is adjacent a nozzle opening. The pulse to the paddle causes the paddle to immediately curl into position to cause local pressurization of the ink in a nozzle and a meniscus of ink develops at the nozzle exit opening. A heat pulse generated by an annular heating element adjacent the nozzle opening lowers the surface tension of the ink in the meniscus and also thus lowers the amount of energy necessary to generate and expel an ink droplet from the nozzle opening. The end result is that an ink droplet is expelled at a high velocity from the nozzle opening which in turn causes it to strike its intended position on a printing medium with greater accuracy. Additionally, the mechanical stress experienced by the thermally-actuated paddle during the ink droplet generation and expulsion operation is less than it otherwise would be if there were no heater for assisting in the generation of ink droplets. Consequently, the mechanical longevity of the thermally-actuated paddle is lengthened.

SUMMARY OF THE INVENTION

This invention uses a newly discovered type of micro-electromechanical vibrating beam to break up an ink stream in a continuous inkjet printing system, or to eject drops in a drop-on-demand inkjet printing system. Such beams, which are composed of two or more layers of materials with different coefficients of thermal expansion, at least one of which is an electrical conductor, and which are attached to walls at both of their ends, have vibrational frequencies that depend in an unexpected and useful way on temperature. At relatively lower temperatures, the vibrational frequencies of such beams decrease as temperature increases. At relatively higher temperatures, the vibrational frequencies increase as temperature increases. Therefore, there is an intermediate temperature at which the vibrational frequency is a local minimum as a function of temperature, and thus is particularly stable against fluctuations in temperature.

By adjusting the beam's temperature to be the temperature at which it is optimally stable to fluctuations in temperature, or by fabricating the beam in such a way that this temperature is the beam's operating temperature, one can construct an oscillating member that will vibrate reliably at a given frequency with a relative stability in amplitude of motion, and which can aid in stream breakup or droplet ejection in an inkjet printing system or liquid moving systems such as a pump.

The objects, features and advantages of the present in invention will become more apparent upon a consideration of the following description of the preferred embodiments of the present invention taken in conjunction with the accompanying drawings.

DETAILED DESCRIPTION OF THE PREFERRED EMBODIMENTS

The present description will be directed in particular to elements forming part of, or cooperating more directly with, apparatus in accordance with the present invention. It is to be understood that elements not specifically shown or described may take various forms well known to those skilled in the art.

Figure 1:
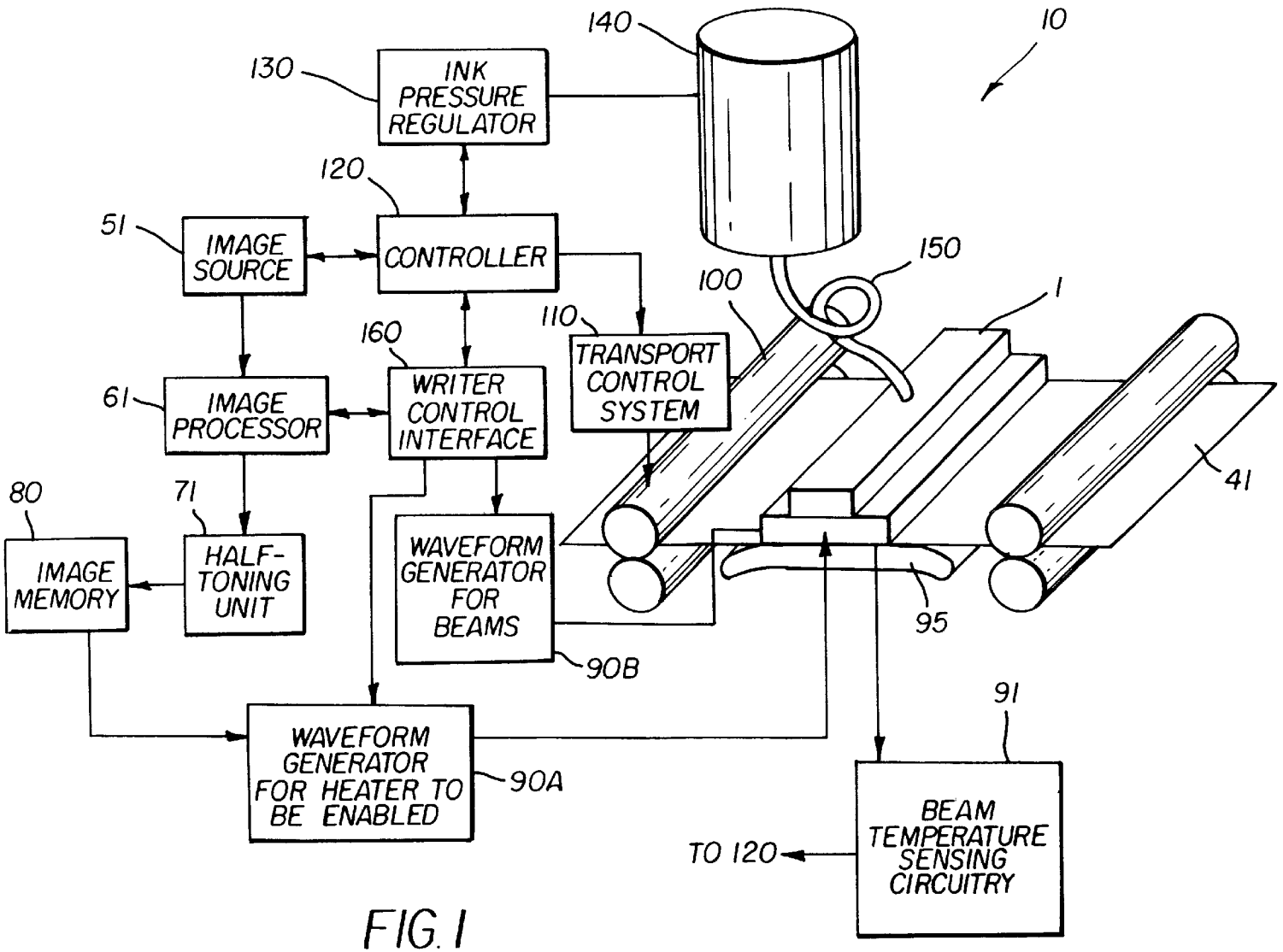
FIG. 1 is a schematic illustration of a drop-on-demand ink jet printer that may incorporate the present invention.

Referring now to FIG. 1, there is shown an imaging apparatus in the form of a DOD (Drop-on-Demand) ink jet printer, generally referred to as 10. Printer 10 is capable of controlling ejection of an ink droplet from a printhead 1 to a receiver 41, as described more fully hereinbelow. Receiver 41 may be a reflective-type (e.g., paper) or transmissive type (e.g., transparency) receiver.

As shown in FIG. 1, imaging apparatus 10 comprises an image source 51, which may be raster image data from a scanner or computer, or outlined image data in the form of a PDL (Page Description Language) and or other form of digital image representation. This image data is transmitted to an image processor 61 connected to image source 51. Image processor 61 converts the image data to a pixel mapped page image. Image processor 61 may be a raster image processor in the case of PDL image data to be converted, or a pixel image processor in the case of raster image data to be converted. In any case, image processor 61 transmits continuous tone data to a digital half toning unit 70 connected to image processor 51. Half toning unit 70 halftones the continuous tone data produced by image processor 61 and produces halftoned bitmap image data that is stored in image memory 80, which may be a full page memory or a band memory depending on the configuration of imaging apparatus 10. Waveform generator 90A is connected to image memory 80 and responds to data read from image memory 80 to apply electrical pulse stimuli to printhead 1 for reasons disclosed hereinbelow.

Referring again to FIG. 1, receiver 41 is moved relative to printhead 1 and across a supporting platen or roller 95 by means of a plurality of transport rollers 100, which are electronically controlled by transport control system 110. Transport control system 110 in turn is controlled by a suitable controller 120 which preferably includes a micro-computer suitably programmed as is well known to provide control signals for controlling operation of the printer. It may be appreciated that different mechanical configurations for receiver transport control may be used. For example, in the case of a pagewidth printhead, it is convenient to move receiver 40 past a stationary printhead 1. On the other hand, and in the case of scanning-type printing systems, it is more convenient to move printhead 1 along one axis (i.e., the sub-scanning or auxiliary scanning direction) and receiver 41 along an orthogonal axis (i.e., a main scanning direction), in relative raster motion.

Still referring to FIG. 1, controller 120 may be connected to an ink pressure regulator 130 for controlling regulator 130. Regulator 130, if present, is capable of regulating pressure in an ink reservoir 140. Ink reservoir 140 is connected, such as by means of a conduit 150, to printhead 30 for supplying liquid ink to printhead 1. In addition, controller 120 controls a writer control interface 160 that is in turn connected to and controls waveform generators 90A and 90B, which provide signals to beans and heater elements associated with individual nozzles in printhead 1 for reasons provided hereinbelow. Moreover, waveform generator 90A receives signals from image memory 80 and writer control interface 160 to determine which of the corresponding heater elements are to be selectively enabled and their respective timings of enablement.

Generally and as is well known, printhead 1 may comprise a printhead body. Printhead body may have one or more elongate channels cut therein with a backing plate spanning the channels. The channel or channels are capable of accepting ink controllably supplied thereinto from reservoir 140, so as to define an ink body in each channel. The channel or channels feed ink to respective nozzles formed in the printhead body. The printhead body also may include a surface on which is affixed an orifice plate having a plurality of generally circular (or other shaped) orifices formed therethrough and each aligned with a respective one of the ink nozzles. Alternatively the orifices may be formed in an insulating membrane formed upon a substrate such as of silicon that includes the nozzles and ink delivery channels formed therein and that is doped to provide CMOS circuitry for use in controlling electrical pulses to the heater elements and the beams. In this regard reference is made to U.S. application serial number filed in the name of Trauernicht et al. the contents of which are incorporated herein by reference.

With reference now to FIGS. 2–4*e*, wherein like components are designated by like reference numerals throughout all of the several figures, a preferred embodiment of a DOD printhead 1 generally comprises a front substrate 3 having an outer surface 4 and a back substrate 5 having a rear surface 6. A plurality of nozzles 7 are disposed within the substrate 3, only one of which is shown. Each nozzle has straight or tapered side walls 11, and a circular nozzle outlet 15. An ink conducting channel 17 is provided between the substrates 3, 5 for providing a supply of liquid ink to the interior of the nozzle 7. The liquid ink forms a concave meniscus 19 around the nozzle outlet 15. Each nozzle 7 is provided with a droplet separator, which is illustrated as comprising a thermally-actuated beam 21 and a heater element 32. It will be understood that the channel 17 is continuous along the length of the printhead whereas the beams 21 are located below each respective nozzle with one beam being associated with a respective nozzle.

In operation, continuous electrical D.C. current is applied to the beam 21 to maintain the beam at a stable predetermined temperature that will establish stable frequency operation of the beam as will be made clear below. The beam is also continuously provided with varying voltage electrical pulses at a predetermined frequency to cause beam vibrations. Of course, D.C. current may be replaced by very high frequency pulsing to emulate a D.C. pulse. The continuous pulsing at the predetermined frequency generates heat pulses each of which momentarily heats up the beam 21. As the beam is formed from two materials having different coefficients of expansion, it momentarily displaces from its equilibrium position shown in FIG. 4*a* to that shown in FIG. 4*b*. A shockwave is created in the liquid ink in the channel beneath the nozzle opening 7 results in the formation of an expanded meniscus 19 (see FIG. 4*b*). However, such thermally-actuated beams 21 do not cause a drop to be ejected. FIGS. 4*a–e* illustrate one complete oscillation of the beam 21 at a non-selected nozzle. The non-selected nozzle implies that no heating pulse is provided to the heater elements at the nozzle opening. As shown in these FIGS. 4*a–e* the meniscus oscillates but no drop is released from this nozzle.

With reference now to FIGS. 5*a–e*, a nozzle exit-opening heater comprising an annular heating element 32 closely circumscribes the nozzle outlet 15. Such a heater may easily be integrated onto the top surface 4 of the printhead by way of CMOS technology. When an electrical pulse is conducted through the annular heating element 32, the heating element 32 generates a momentary heat pulse which in turn reduces the surface tension of the ink in the vicinity of the meniscus 19. Such heaters and the circuitry necessary to drive them are disclosed in U.S. Pat. No. 6,079,821, however in this DOD application the heater elements are annular.

In operation, droplets of ink are generated by conducting respective electrical pulses to each of the thermally-actuated beams 21 and the heating elements 32. Heating elements that are to be enabled to cause droplet ejection are preferably energized at a small advance of about 2–3 microseconds before the respective beam is in a cycle of its normal vibration that would cause the beam to be in its closest proximity to the nozzle opening. As noted above, the beam 21 is continuously actuated by pulses thereto to cause vibrational displacement from its normal equilibrium heated position shown in FIGS. 5*a* and 5*e*. With movement of the beam upwardly towards the nozzle opening and into a position indicated in FIG. 5*b* and assuming a heat pulse has been generated by the annular heating element 32, a combination of the lowering of the surface tension of the ink in the meniscus 19 and a shockwave introduced by the beam causes the pending droplet 23 to be expelled from the nozzle outlet 15. The ink is preferably formulated to have a surface tension which decreases with increasing temperature. The application of heat pulses by the heater element 32 causes a temperature rise of the ink in the neck region of the meniscus. In this regard, temperature of the neck region is preferably greater than 100 degrees C. but less than a temperature which causes the ink to form a vapor bubble. With heating of the ink in the neck region, there is a reduction in surface tension which causes increased necking instability of the expanding meniscus which is due to the action of the beam 21. The heater element of each nozzle selected to eject a droplet may be actuated for a time period of approximately 20 microseconds. The end result is that an ink droplet 23 is expelled at a high velocity from the nozzle outlet 15 which in turn causes it to strike its intended position on a printing medium with great accuracy. There is no need for application of external forces to the droplet to attract the droplet to the receiver as may be required in other devices, for example, electrostatic attraction of the droplet to the receiver. Additionally, the mechanical stress experienced by the thermally-actuated beam during the ink droplet generation and expulsion operation is less than it otherwise would be if there were no heater element 32 for assisting in the generation of ink droplets. Consequently, the mechanical longevity of the thermally-actuated beam is lengthened. In the various embodiments described herein the actuation of a heater element associated with a nozzle is only done to those nozzles upon which an ink droplet is to be ejected at a particular time; i.e. they are selectively enabled or actuated when creation of the droplet is required at the particular nozzle and at a particular time. As noted above, the timing is such that actuation of the heating pulse to the heater element is timed to be slightly before movement of the beam to the position indicated in FIG. 5*b*. When a droplet is not to be ejected from a particular nozzle no current need be provided to the heater element associated with that nozzle. However, a DC electrical pulse and a pulse of predetermined frequency is applied to the beam to maintain the beam at a predetermined temperature and vibration frequency and amplitude of the beam's movement as will be described.

Figure 2:
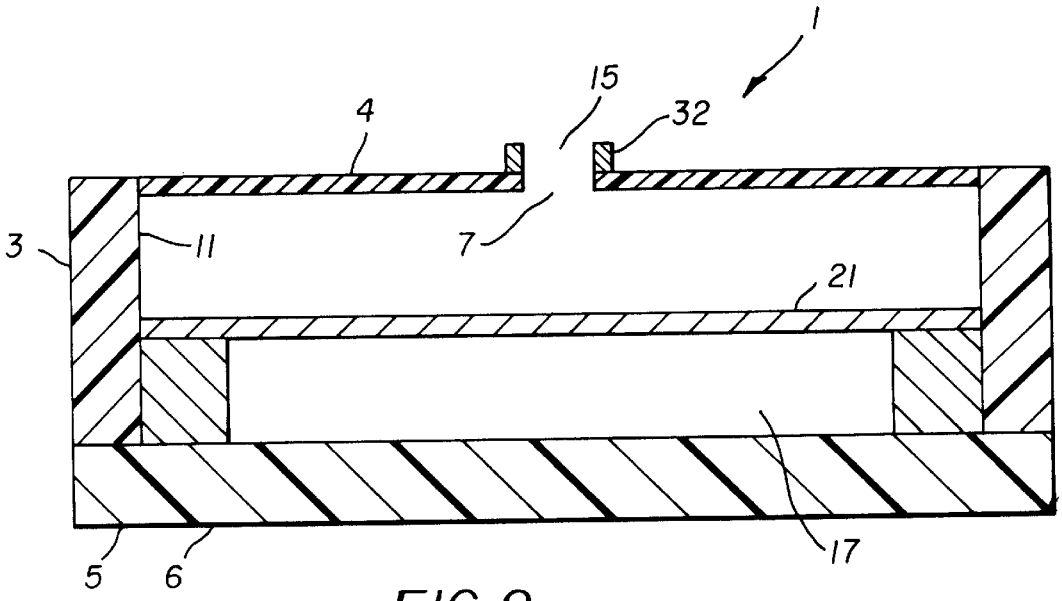
FIG. 2 is a schematic of a nozzle that forms a part of a drop-on-demand ink jet printhead in accordance with the invention.
Figure 3:
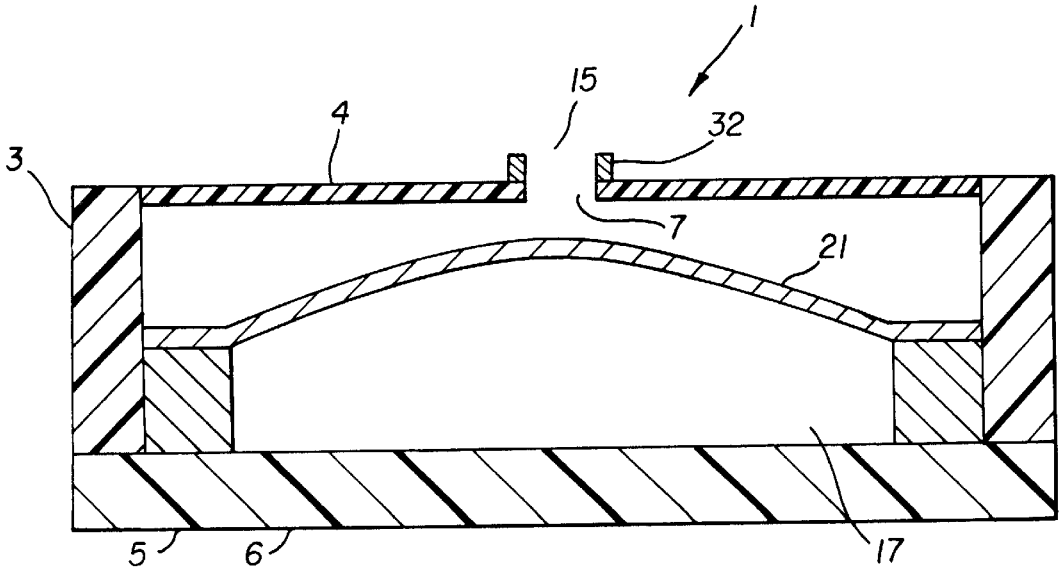
FIG. 3 is a view similar to that of FIG. 2 and illustrates a beam that is heated to provide a displacement of the center of the beam from a central position illustrated in FIG. 2.
Figure 4A:
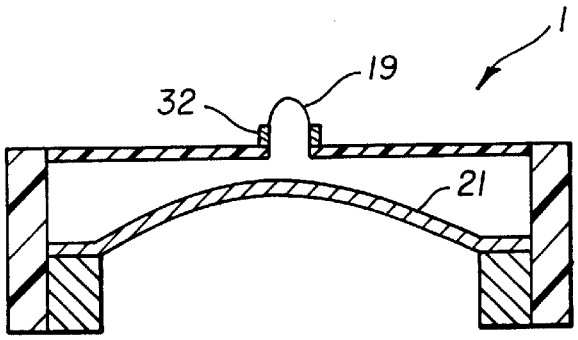
FIGS. 4*a*, 4*b*, 4*c*, 4*d* and 4*e* illustrate various positions of the heated beam of FIG. 3 in operation wherein a heater element adjacent the nozzle opening is not heated so that the meniscus oscillates during oscillation of the beam but no drop is released from the nozzle.
Figure 4B:
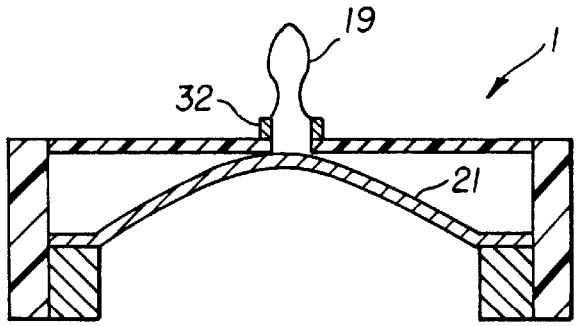
Figure 4C:
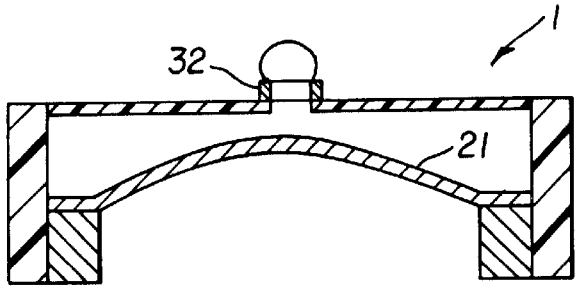
Figure 4D:
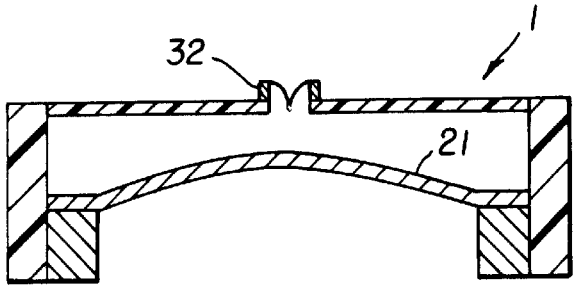
Figure 4E:
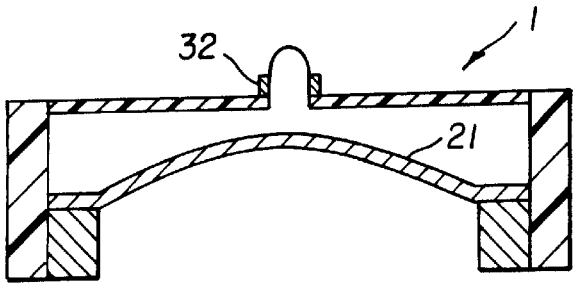
Figure 5A:
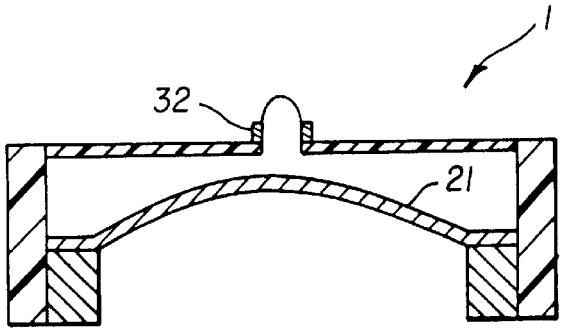
FIGS. 5*a*, 5*b*, 5*c*, 5*d* and 5*e* illustrate various positions of the heated beam of FIG. 3 in operation wherein the heater element adjacent the nozzle opening is heated so that a drop is released from the nozzle during one oscillation of the beam.
Figure 5B:
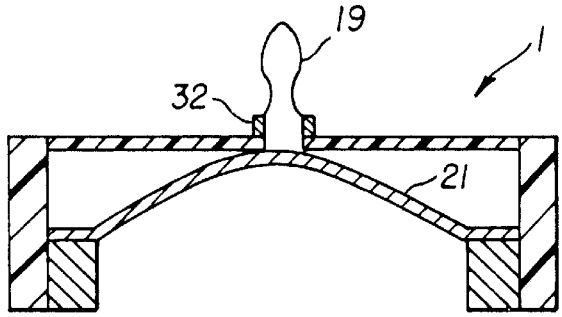
Figure 5C:
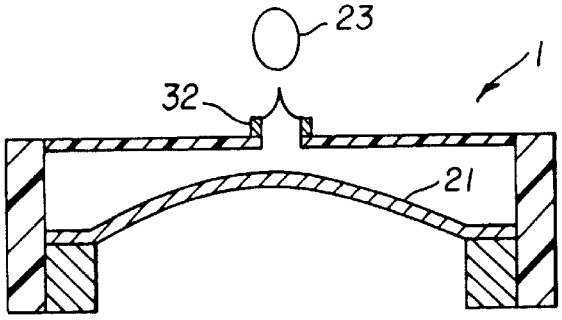
Figure 5D:
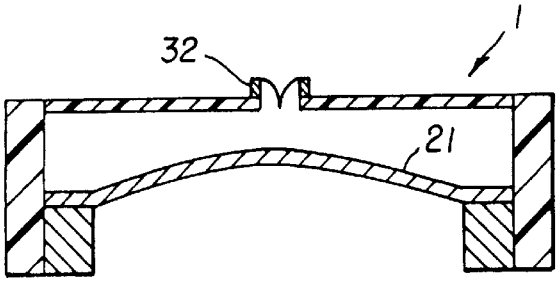
Figure 5E:
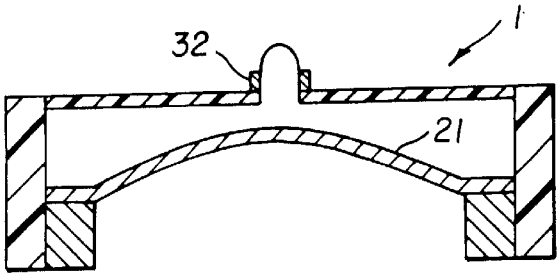

In a variation of the embodiment of the invention illustrated in FIG. 2, the heater element may comprise an annular heating element which circumscribes the upper cylindrical side walls of the nozzle. While such a variation of the invention is slightly more difficult to manufacture, it has the advantage of more effectively transferring the heat pulse generated by the heater element to the ink forming the meniscus. In this regard, reference is made to FIG. 3 of United States patent application publication U.S. Ser. No. 2001/0045973 A1. In all other respects, the operation of this variation of the invention is the same as that described with respect to FIGS. 5*a–e*.

In the drop-on-demand inkjet version of this invention as described above, a stable vibrating beam is positioned under each nozzle. It operates as the separation mechanism in a two-stage drop ejection scheme, along with any of various drop selection mechanisms. The beam is tuned to its stable frequency with a DC current that is chosen to raise the beam's temperature to the temperature at which its frequency is most stable with regard to small temperature excursions of the beam. The current is then pulsed periodically at that frequency in order to maintain the beam's vibration at the resonant vibration frequency of the beam. Alternatively, the beam is driven at a desired frequency with a varying voltage. For a given amplitude of the driving signal, the amplitude of the beam's motion will vary with frequency, the maximum of that response being very near the resonant frequency of the structure (depending on the damping). The pressure pulses caused by the beam's oscillation impart momentum to the ink or other liquid in the nozzle, momentum that by itself is insufficient to eject a drop from the nozzle, but which, when combined with the effect of the drop selection mechanism; e.g., thermoelectric surface tension reduction, is sufficient to eject a drop from the nozzle. The benefit of operating at a local frequency minimum at a relatively elevated temperature is this increases the stability of the amplitude of motion of the beam. Elevated temperatures for the beam may, for example, be in the range 50 degrees centigrade to 250 degrees centigrade with cooler temperatures being preferred.

Figure 6C:
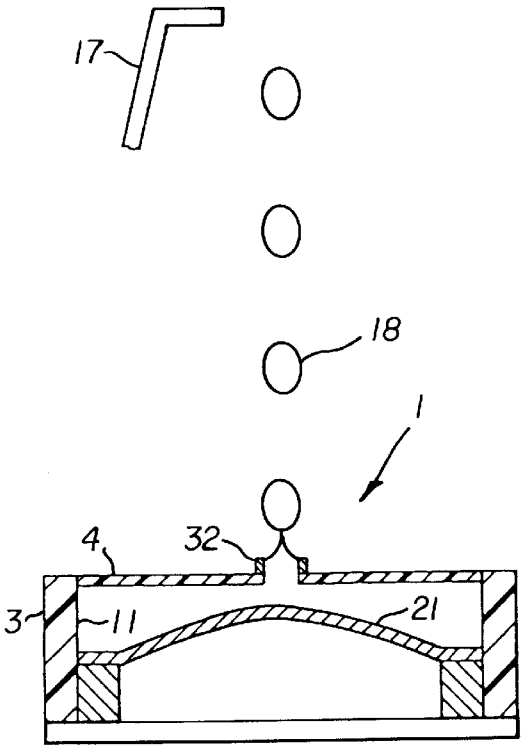
FIGS. 6*a*, 6*b* and 6*c* illustrate various operating times of a second embodiment of the invention in the context of a continuous inkjet printer.
Figure 6B:
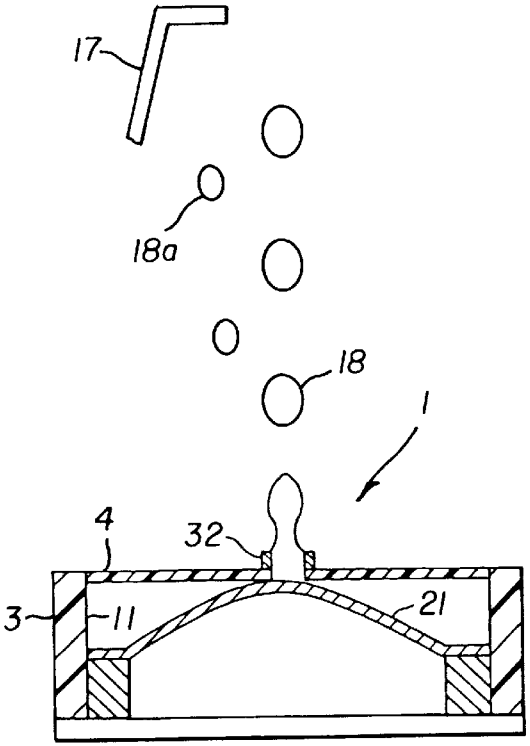
Figure 6A:
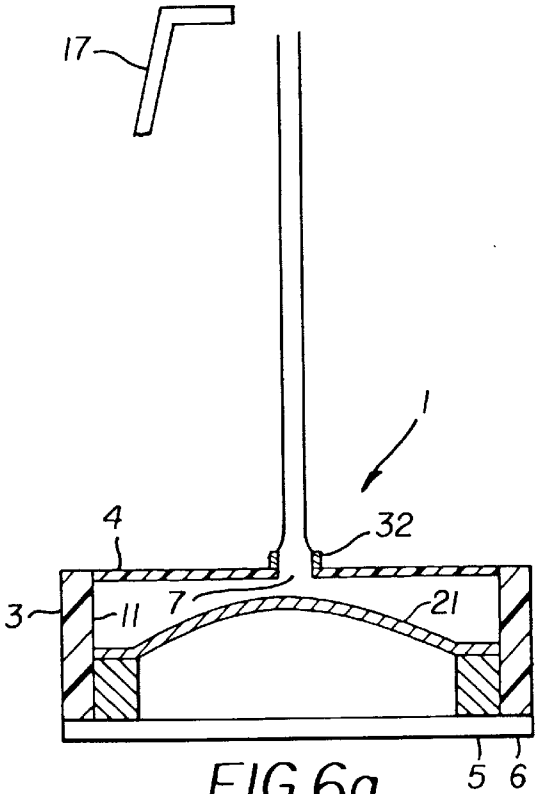
Figure 7:
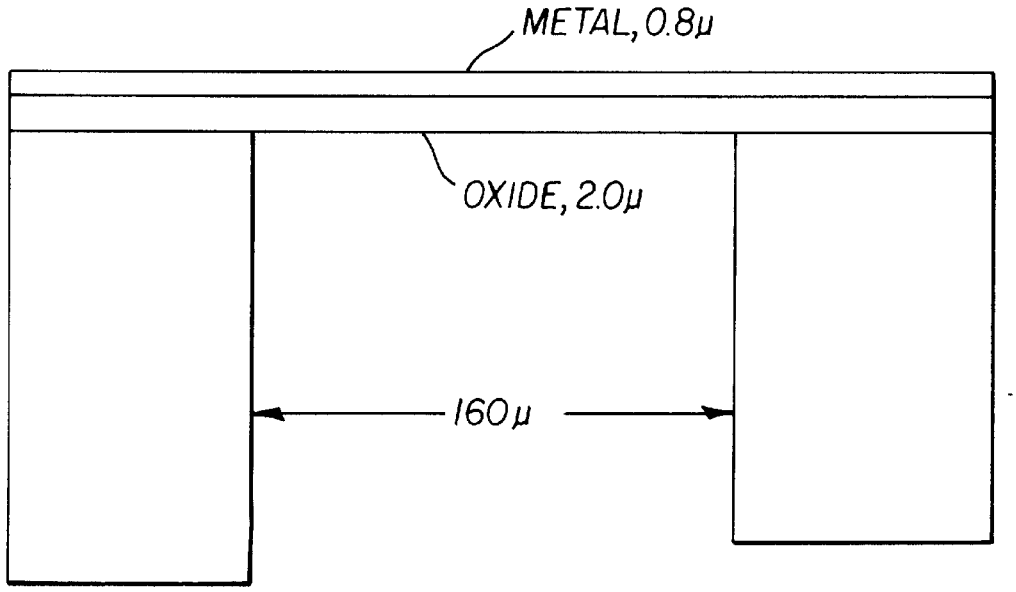
FIG. 7 illustrates a typical bimetallic beam micro-actuator, the dimensions shown representing an experimental embodiment discussed with reference to the graph of FIG. 8.

The continuous inkjet version of this invention will be described with reference to FIGS. 6*a–c*, wherein like numerals are used to represent corresponding counterpart structure similar to that described for the DOD embodiment, the pressure in the ink chamber is held at a level above the atmospheric pressure sufficient to emit a continuous stream of fluid from the nozzles. There is a clamped multilayer beam 21 near each nozzle exit opening. The materials and dimensions of the beam are chosen so that the beam's vibrational frequency is stable with respect to temperature fluctuations at the frequency at which the drops are to be formed. The beam is heated to the temperature at which the vibrational frequency is stable with respect to temperature fluctuations by passing an appropriate direct current through one or more conductive layers of the beam. Periodic fluctuations in the current, of the same frequency as the desired frequency of vibration of the beam, are applied to the beam to establish the resonant vibration of the beam. The periodic fluctuations in the current may be provided by a varying voltage pulse of predetermined frequency that is applied to the beam. Vibration of the beam near the nozzle opening induces a periodic perturbation of the ink flow in the vicinity of the nozzle opening and causes the stream, which is intrinsically unstable, to break up into droplets 18 at the frequency of the perturbation. Directional control of the droplets is provided by selectively applying heat to the stream at the nozzle opening by application of electrical current to the heater element 32 to cause the heater element 32 to be heated. During typical printing the frequency of application of heat to a heater element will be substantially less than the beam frequency. The selective heating of the heater element 32 is in accordance with image data determining whether or not a drop is to be positioned on the receiver member (droplets 18) at a particular time or collected by the gutter 17 (droplets 18*a*). In accordance with one mode of operation selective heating of the heater element 32 causes a droplet to be deflected and caught by a gutter or drop catcher 17 while undeflected droplets advance to the receiver member. Alternatively, selective heating of the heater element 32 causes a droplet to be deflected to the receiver member while an undeflected droplet advances to the gutter or drop catcher and is caught. In order to provide this deflection of the stream the heater element 32 may comprise a generally annular heater element having a notch formed therein so that when current is provided to the heater element the heater element selectively heats asymmetrically and causes a corresponding deflection of a droplet as described by the patent to Chwalek et al. referred to above, the description of which is incorporated herein by reference. In lieu of a heater element formed with a notch, the heater element may comprise separate heating sections that can be separately enabled as taught by Chwalek et al.

Figure 8:
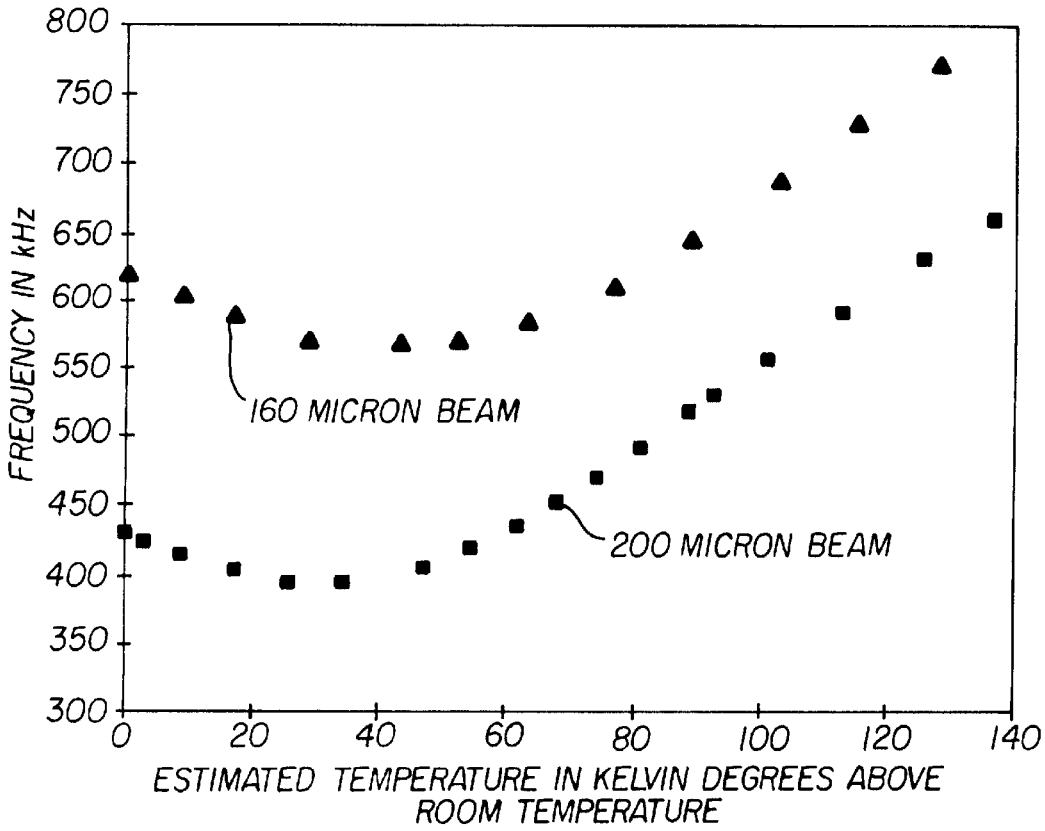
FIG. 8 illustrates a graph of experimental data showing a frequency relationship with temperature of the bimetallic beam micro-actuator of FIG. 7.

The invention derives from the experimental discovery by the inventors that the vibrational frequencies of clamped multilayer microbeams depend on temperature in the manner exemplified in FIG. 8. Preferably the beams consist of a thin layer of a metal, for example—a titanium/aluminum alloy—built upon a thicker layer of silicon oxide, anchored to silicon walls at each end. Other combinations of layers of different materials may also be used. Because the metal's coefficient of thermal expansion is much larger than that of the oxide, when current is run through the metal in order to heat the beam, heating of the beam produces a thermal moment that bends the beam. In experiments performed by the inventors to determine the influence of temperature on the vibrational frequency of such micro-beams it was unexpected to find that the vibrational frequency of such microbeam is nonmonotonic as a function of the beam's temperatures. At relatively lower temperatures, the frequency decreases with increasing temperature. The frequency achieves a minimum as a function of temperature, and then increases monotonically for relatively higher temperatures (see FIG. 8) The inventors have been able to establish through a mathematical model that predicts favorably the results of the experiments the identity of the physical causes of this unexpected behavior, and thus to establish it as a general phenomenon.

There is no simple algebraic formula for the frequency of the beam as a function of temperature. The fundamental frequency for a given temperature T is the smallest value of f for which the system of ordinary differential equations and boundary conditions $$\frac{Eh^3}{12(1-\sigma^2)}\frac{\partial^4 F}{\partial x^4} + Eh\frac{\partial}{\partial x}\left(\left(\alpha T - s - \frac{3}{2}\left(\frac{\partial \eta}{\partial x}\right)^2\right)\frac{\partial F}{\partial x}\right) = \rho h 4\pi^2 f^2 F$$

$$F(0) = 0 \qquad F(L) = 0$$

-continued $$\left.\frac{\partial^2 F}{\partial x^2}\right|_{x=0} = k\left.\frac{\partial F}{\partial x}\right|_{x=0} \qquad \left.\frac{\partial^2 F}{\partial x^2}\right|_{x=L} = -k\left.\frac{\partial F}{\partial x}\right|_{x=L}$$

$$\frac{Eh^3}{12(1-\sigma^2)}\frac{\partial^4 \eta}{\partial x^4} + Eh\frac{\partial}{\partial x}\left(\left(\alpha T - s - \frac{1}{2}\left(\frac{\partial \eta}{\partial x}\right)^2\right)\frac{\partial \eta}{\partial x}\right) = 0$$

$$\eta(0) = 0 \qquad \eta(L) = 0$$

$$\left.\frac{\partial^2 \eta}{\partial x^2}\right|_{x=0} = k\left.\frac{\partial \eta}{\partial x}\right|_{x=0} - cT - r \qquad \left.\frac{\partial^2 \eta}{\partial x^2}\right|_{x=L} = -k\left.\frac{\partial \eta}{\partial x}\right|_{x=L} - cT - r$$

has a solution with F(x) not identically equal to 0. Here, $\eta(x)$ is a function whose graph is the equilibrium shape of the beam, F(x) is the amplitude of vibration as a function of position along the beam, E, h, $\sigma$, $\alpha$, s, $\rho$, L, k, c and r are the Young's modulus in units of dynes/cm$^2$, the thickness in units of cm, the dimensionless Poisson ratio, the dimensionless coefficient of thermal expansion, the dimensionless residual strain, the density in units of grams/cm$^3$, the length in units of cm, the wall stiffness coefficient in units of cm$^{-1}$, the thermal moment coefficient in units of (degrees K)$^{-1}$cm$^{-1}$, and the residual moment of the beam in units of cm$^{-1}$.

The effective material properties of a multilayer beam, such as the Young's modulus, the Poisson ratio, the coefficient of thermal expansion, the density, and the thermal moment coefficient, are computed as weighted averages of the material properties of the component layers. Let us denote the quantities that characterize the bottom layer with a subscript 1, and those of the $j^{th}$ layer from the bottom with a subscript j, so that $h_j$, $E_j$, $\rho_j$, $\alpha_j$, and $\sigma_j$ are respectively the thickness, the Young's modulus, the density, the coefficient of thermal expansion, and the Poisson's ratio of the material in the $j^{th}$ layer in the same units as their un-subscripted analogs. Then if there are N layers, the effective parameters are defined by $$h = \sum_{j=1}^{N} h_j$$

$$E = \frac{\sum_{j=1}^{N} E_j h_j}{\sum_{j=1}^{N} h_j}$$

$$\rho = \frac{\sum_{j=1}^{N} \rho_j h_j}{\sum_{j=1}^{N} h_j}$$

$$\alpha = \frac{\sum_{j=1}^{N} \frac{\alpha_j h_j E_j}{1-\sigma_j}}{\sum_{j=1}^{N} \frac{h_j E_j}{1-\sigma_j}}$$

$$1-\sigma^2 = \frac{Eh^3}{12}\frac{1}{\sum_{j=1}^{N}\frac{1}{3}[(y_j - y_c)^3 - (y_{j-1} - y_c)^3]\frac{E_j}{1-\sigma_j^2}}$$

-continued $$\text{where } y_0 = 0, \quad y_j = \sum_{k=1}^{j} h_k, \quad \text{and } y_c = \frac{\sum_{j=1}^{N}\frac{1}{2}\frac{E_j(y_j^2 - y_{j-1}^2)}{1-\sigma_j^2}}{\sum_{j=1}^{N}\frac{E_j h_j}{1-\sigma_j^2}}$$

$$c = \frac{\sum_j \frac{1}{2}(y_j^2 - y_{j-1}^2)(\alpha - \alpha_j)\frac{E_j}{1-\sigma_j}}{\sum_j \frac{1}{3}[(y_j - y_c)^3 - (y_{j-1} - y_c)^3]\frac{E_j}{1-\sigma_j}}$$

It is preferred that the composite layers forming the beams extend to become part of the walls. Preferably the beams may be fabricated on silicon wafers and are thus well suited to fabrication using MEMS technology. As an example the beam may be formed by depositing a 2 micrometer layer of oxide on the silicon wafer using plasma enhanced chemical vapor deposition. A 0.8 micrometer metal layer may then be deposited on the oxide by sputter deposition. Through photo lithographic patterning, the metal and oxide layers may be etched back to form beams of a desired length. The beams may then be released using a deep isotropic silicon etchant in a plasma using the oxide layer as a mask.

Vibrational frequency of the beams may be monitored by detecting the change in the angle of a focused laser beam reflected off the top surface of the beam using a position-sensitive detector. Heating of the beam is done by passing current through the metal layer. To cause the beam to vibrate, voltage pulses may be provided such as 0.5 to 1 microsecond wide pulses gated to a constant baseline voltage. The baseline voltage provides the heating needed for maintaining the temperature at the resonant frequency of the beam, while the short voltage pulse provides excited vibrations. As the beam is formed on the silicon wafer, circuitry may be formed in the silicon wafer or oxide layers formed thereon to provide the needed current pulses and DC heating current to the beam. It may not be necessary to measure the actual temperature of the beams, as it may be assumed that temperature is related to the heating power provided by the baseline voltage. However, circuitry may be provided on the beam or in or near the ink or the beam to generate a signal that can be sensed externally of the printhead that is indicative of the temperature of each beam. The signals may be communicated to the controller 120 by temperature sensing circuitry 91 to adjust the DC component of the signals provided to the beam to maintain the beam at the resonant frequency thereof.

It is believed that as the beam's temperature increases, it tries to expand but it cannot do so because it is constrained by the walls of the nozzle. The constraining stress acts as an anti-restoring force on the beam. Thus, for low temperatures, the beams vibrational frequency decreases. Additionally a thermal moment is produced by the differential thermal expansion of the beam's layers. Because the wall of the nozzle is somewhat pliable, the beam is not perfectly clamped. As the beam's temperature increases, this thermal moment twists the beam at its end points, and thus bends the beam.

There has thus been described an improved beam micro-actuator which quite unexpectedly provides enhanced stability when operated at the temperature and frequency representing a relative minimum operating frequency. Small demarcations in temperature at such minimum represent relatively very minute changes in frequency. Such stability in frequency with temperature provides stability in beam amplitude of displacement for consistency in operation of droplet formation and/or movement of liquid or other fluids whether in ink jet printer or in other devices requiring movement of the fluids by such micro-actuators. In lieu of operating at or near the relative minimum frequency it may be desired to operate at other frequencies to obtain a desired amplitude of beam displacement or for other reasons, e.g. one wants a particular beam frequency. In the continuous ink jet case, a beam may be provided that is under a row of nozzles or instead have one respective beam associated with each respective nozzle as in the drop on demand case The ink jet recording apparatus as described herein may be used as an output terminal of an information processing apparatus such as a computer or the like, as a copying apparatus combined with an image reader or the like, or as a facsimile machine having information sending and receiving functions.

The recording material is not limited to paper or plastic but is applicable to cloth such as various fabrics or to other materials upon which ink is to be deposited. In addition, the ink may be replaced by another type of printing liquid that is suited for selective image wise depositing upon a lithographic plate that can then be used to selectively receive printing ink at different pixel locations on the plate for ultimate transfer to a receiver sheet.

Although the invention has been described with regard to a heating element being associated with an exit opening to determine drop separation in the drop on demand case, it is contemplated that other means for causing drop separation in the drop on demand case once a meniscus is formed may also be provided for. For example, an electrical charge may be provided to the ink while in the printhead nozzle and a selective electrostatic attraction may be provided near selected nozzles by means external to the printhead to attract a meniscus of the ink to separate from the respective nozzle exit outlet in accordance with the requirements of image data to be printed.

While the invention has been described with reference to the structures disclosed herein such as for ink jet printing, the invention is also applicable to other structures and methods of moving liquid such as micro-electro mechanical pumps. The invention is not confined to the detailed embodiments set forth herein, and thus this application is intended to cover such modifications or changes as may come within the scope of the following claims.

The invention has been described in detail with particular reference to certain preferred embodiments thereof, but it will be understood that variations and modifications can be effected within the spirit and scope of the invention.

What is claimed is:

1. A droplet generator for generating droplets for depositing upon a receiver member, comprising:

an ink jet printhead having a nozzle with an exit outlet, and a printing liquid supply for conducting a printing liquid to said nozzle;

a vibrating beam constrained at both ends of the beam within or near the nozzle, the beam being continuously vibrated within the printing liquid at a predetermined frequency; and a heating element located at or near the exit outlet of the nozzle for selectively heating the printing liquid at the exit outlet of the nozzle to selectively control droplet formation and/or droplet direction leaving the printhead.

2. The droplet generator of claim 1 and wherein the printhead is a continuous ink jet printhead and wherein the printhead includes a gutter or droplet catcher for catching selected droplets not selected to be printed and the vibrating beam causes droplet breakup of the stream of ink exiting the nozzle exit outlet.

3. The droplet generator of claim 2 and wherein the printhead includes a plurality of the said nozzle each having an exit outlet and the printing liquid supply provides the printing liquid to each of the nozzles and wherein the nozzles are arranged in a row and the vibrating beam is associated with a plurality of the nozzles.

4. The droplet generator of claim 2 and wherein the beam is maintained at a predetermined operating temperature wherein the resonant frequency of vibration of the beam is at about a local minimum point.

5. The droplet generator of claim 1 and wherein the printhead is a drop-on-demand ink jet printhead and wherein the printhead includes a plurality of nozzles each with a respective exit outlet and a respective said heating element and wherein the controller controls which heater elements are to be selectively heated during a predetermined recording period and these selected heater elements are heated to an extent required to release a respective droplet from a respective nozzle and the predetermined frequency establishing a predetermined amplitude of displacement of the beam.

6. The droplet generator of claim 5 and wherein the beam is maintained at a predetermined operating temperature wherein the resonant frequency of vibration of the beam is at about a local minimum point.

7. The droplet generator of claim 5 and wherein the beam is formed of at least two layers of different materials having different coefficients of thermal expansion.

8. The droplet generator of claim 1 and wherein the printhead is a drop-on-demand ink jet printhead and wherein the printhead includes a plurality of nozzles each with a respective exit outlet and a respective said heating element and wherein the controller controls which heater elements are to be selectively heated during a predetermined recording period and these selected heater elements are heated to an extent required to release a respective droplet from a respective nozzle and a different vibrating beam is associated with each of the plurality of nozzles and each vibrating beam is constrained at both ends of the beam within or near the respective nozzle, each beam being continuously vibrated within the printing liquid at a predetermined frequency.

9. The droplet generator of claim 8 and wherein each beam is a metallic layer formed on an oxide layer.

10. The droplet generator of claim 9 and wherein each beam is formed of at least two layers of different materials having different coefficients of thermal expansion.

11. The droplet generator of claim 1 and wherein the beam is maintained at a predetermined operating temperature wherein the resonant frequency of vibration of the beam is at about a local minimum point.

12. The droplet generator of claim 1 and wherein the beam is formed of at least two layers of different materials having different coefficients of thermal expansion.

13. A method of generating liquid droplets from a liquid droplet generator having a nozzle exit outlet and a droplet separation device for causing selective droplet separation, the method comprising the steps of:

providing a beam constrained at both ends of the beam; and providing pulsing energy to the beam to vibrate the beam and establishing a desired beam displacement amplitude that will cause a meniscus to develop at the nozzle exit outlet without the beam itself causing generation of a free droplet.

14. The method of claim 13 and wherein a droplet is selectively separated from the printhead in response to image information by enablement of a droplet separation device that selectively operates to cause generation of a free droplet.

15. The method of claim 14 and wherein the beam is formed of at least two layers of different materials having different coefficients of thermal expansion.

16. The method of claim 15 and wherein the beam is maintained at a predetermined operating temperature wherein the resonant frequency of vibration of the beam is at about a local minimum point.

17. A method for generating droplets of a printing liquid from a nozzle of an ink jet printhead comprising the steps of:

providing a temperature responsive vibrating beam constrained at both ends of the beam within or near a nozzle, the nozzle having an exit outlet, the beam being continuously vibrated within the printing liquid in response to electrical pulsing applied to the beam so that the beam vibrates at a predetermined frequency, and applying energy to a heating element located at or near the exit outlet of the nozzle to selectively heat the printing liquid at the nozzle exit outlet to selectively control droplet formation and/or droplet direction leaving the printhead.

18. The method of claim 17 and wherein the printhead is a continuous ink jet printhead and wherein the printhead includes a gutter or droplet catcher for catching selected droplets not intended to be printed and wherein the vibrating beam causes droplet breakup of the stream of ink exiting the nozzle exit outlet.

19. The method of claim 18 and wherein the beam is maintained at a predetermined operating temperature wherein the resonant frequency of vibration of the beam is at about a local minimum point.

20. The method of claim 18 and wherein the beam is formed of at least two layers of different materials having different coefficients of thermal expansion.

21. The droplet generator of claim 17 and wherein the printhead is a drop-on-demand ink jet printhead and wherein the printhead includes a plurality of nozzles and wherein the heater elements of certain selected nozzles are selectively heated during a predetermined recording period to an extent required to release a droplet from a respective nozzle.

22. The method of claim 21 and wherein the beam is maintained at a predetermined operating temperature wherein the resonant frequency of vibration of the beam is at about a local minimum point.

23. The method of claim 17 and wherein the beam is maintained at a predetermined operating temperature wherein the resonant frequency of vibration of the beam is at about a local minimum point.

24. The method of claim 23 and wherein the beam is formed of at least two layers of different materials having different coefficients of thermal expansion.

25. The method of claim 17 and wherein the beam is formed of at least two layers of different materials having different coefficients of thermal expansion.

26. A method for moving a fluid with a membrane, the method comprising the steps of:

providing a temperature responsive vibrating beam membrane constrained at both ends of the beam, the beam being continuously vibrated within the fluid so that the frequency of vibration of the beam is substantially at a local minimum point at a predetermined temperature whereby minor excursions in temperature of the beam from said temperature provides substantially minimal changes in frequency of vibration of the beam, and wherein movement of the beam causes movement of the fluid.

27. The method of claim 26 and wherein the fluid is a liquid.

28. The method of claim 27 and wherein the liquid is a printing liquid.

29. The method of claim 28 and wherein the printing liquid is an ink.

30. The droplet generator of claim 26 and wherein the beam is formed of at least two layers of different materials having different coefficients of thermal expansion.

* * * * *